US006009824A

United States Patent [19]

Ross

[11] Patent Number: 6,009,824

[45] Date of Patent: Jan. 4, 2000

[54] CLEATS FOR SECURING ROPES AND CHAINS

[76] Inventor: Ian Ross, 1151 Old Esquimalt Road, Victoria, British Columbia, Canada, V9A 4X6

[21] Appl. No.: 09/038,015

[22] Filed: Mar. 11, 1998

[51] Int. Cl.[7] ..... B63B 21/06

[52] U.S. Cl. ..... 114/218; 114/200

[58] Field of Search ..... 24/116 R, 115 R, 24/129 R, 130; 114/210, 199, 200, 218

[56] References Cited

U.S. PATENT DOCUMENTS

| | | | |
|---|---|---|---|
| 533,760 | 2/1895 | Vachon | 114/218 |
| 2,705,467 | 4/1955 | Ogg et al. | 114/210 |
| 2,870,733 | 1/1959 | Winther | 114/218 |
| 3,507,243 | 4/1970 | Brown | 114/218 |
| 5,216,972 | 6/1993 | Dufrene et al. | 114/218 |

*Primary Examiner*—Ed Swinehart

[57] ABSTRACT

A cleat for separately or simultaneously securing a rope and a chain has a pair of cleat horns projecting in opposite directions from an upright portion extending upwardly from a cleat base, the horns being spaced upwardly from the base. A chain link reception slot is downwardly inclined into the upright portion, and is open upwardly and to opposite sides of the upright portion, for receiving and retaining a link of a chain.

19 Claims, 3 Drawing Sheets

CLEATS FOR SECURING ROPES AND CHAINS

BACKGROUND OF THE INVENTION

1. Field of the Invention

The present invention relates to cleats intended to be mounted e.g. on boats or truck trailers for securing ropes and, also, for securing chains.

2. Description of the Related Art

A conventional anchoring equipment on a boat normally comprises a length of chain attached to an anchor and a longer length of rope, which is secured at one end to the chain and, at its opposite end, to the boat, usually to a conventional cleat within a locker in the fore part of the boat. In small boats, the anchor equipment is hauled by hand. In larger vessels there is usually a powered winch provided for hauling the anchor gear. In both cases, there is a need to secure the rope or chain to a dedicated fitting.

Usually, the end of the chain in the locker is shackled to a metal ring or eye-plate which is bolted to a wall structure. The use of this cleat provides a second securing position when the vessel is at anchor, and thus promotes a sense of security.

In some vessels, only a chain is used with the anchor and this represents an increasing trend. In vessels where a winch is used, it is wise practice, when the vessel is at anchor, for the rope or chain to be removed from the winch and secured to the vessel by some other means in order to minimize surge loadings on the winch.

For securing a rope, a conventional cleat comprises a base, which is secured to a deck or other part of a boat by screws or bolts, an upright portion extending upwardly from the base and a pair of horns projecting in opposite directions from the upright portion, above the base. A rope can then be secured to this cleat by looping the rope, in figure eight fashion, beneath the two horns and over the upright portion, in a well-known manner. However, a conventional cleat is not intended or designed for simultaneously securing both a rope and also a chain.

BRIEF SUMMARY OF THE INVENTION

According to the present invention, a cleat comprises an upright portion extending upwardly from a cleat base, with a pair of cleat horns projecting in opposite directions from the upright portion and spaced upwardly from the base, whereby a rope can be secured to the cleat in a conventional fashion. In addition, the cleat according to the present invention is provided with a chain link reception slot extending downwardly into the upright portion, between the horns, the slot being open upwardly and to opposite sides of the upright portion.

In use, a chain link can be slid downwardly into the slot in order, thus, to secure a chain to the cleat.

The present cleat may be used for securing a rope and a chain separately or simultaneously.

In a preferred embodiment of the invention, the slot is inclined and extends downwardly through the upright portion to the base. In use, the cleat is positioned so that the slot is inclined downwardly in the direction of the load expected to be imposed on the chain.

In addition, the upright portion may be provided with one or more through-openings extending through the upright portion. One of these through-openings may then be used to receive an elongate flexible retaining member or twine threaded through that opening and rolled over the chain link in the slot and round the horn at the opposite side of the slot for securing the chain link in the slot.

A further possibility is to provide a light duct extending, preferably in a vertical direction, to a through-opening in the upright portion, for use in making the cleat more readily visible at night.

BRIEF DESCRIPTION OF THE DRAWINGS

The present invention will be more readily apparent from the following description thereof given, by way of example, with reference to the accompanying drawings, in which.

DESCRIPTION OF THE PREFERRED EMBODIMENT

Figure 1:
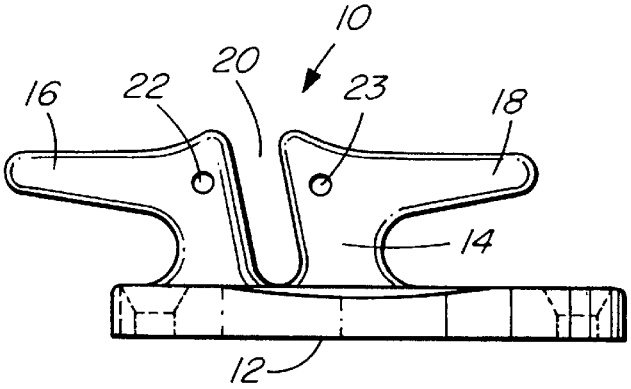
FIG. 1 shows a view in side elevation of a cleat.
Figure 2:
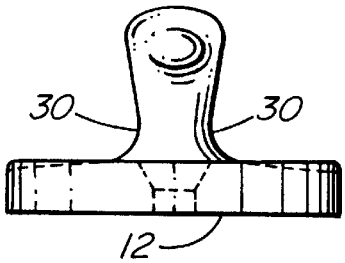
FIG. 2 shows a view in end elevation of the cleat of FIG. 1.

In the accompanying drawings, there is illustrated a cleat which is indicated generally by reference numeral 10. The cleat 10 has a base indicated generally by reference numeral 12, an upright portion 14 extending upwardly from the base and a pair of horns 16 and 18 projecting, in opposite directions, from the upright portion 14, the horns 16 and 18 being spaced upwardly from the base 12.

A chain link reception slot 20 is formed in the upright portion 14 and extends downwardly through the upright portion 14, the slot 20 being open upwardly and at opposite sides of the upright portion 14 and being inclined relative to the base.

As can be seen from FIG. 1, the tops of the horns 16 and 18 are below the top of the upright portion 14 at opposite sides of the slot 20. This enables the slot 20 to be sufficiently deep to receive a chain link, as described below, while allowing the horns 16 and 18 to remain close to the base 12 and thus to avoid being unduly obstructive when the cleat 10 is mounted on a deck.

A pair of through-openings 22 and 23 extend through the upright portion 14, at opposite sides of the slot 20.

Figure 3:
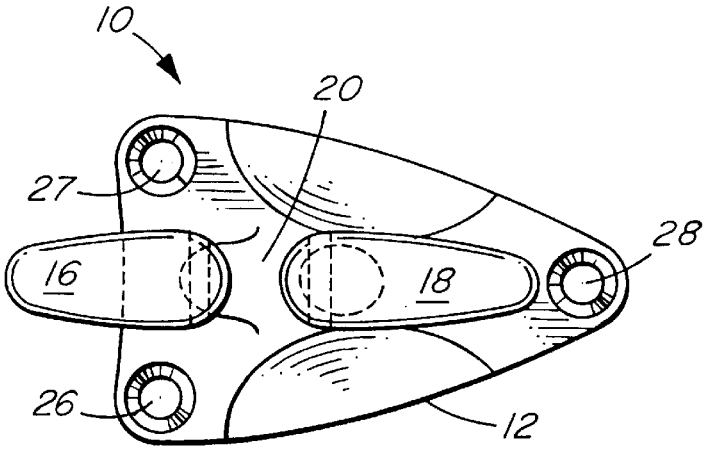
FIG. 3 shows a plan view of the cleat of FIGS. 1 and 2.

As is apparent from FIG. 3, the base 12 is of a generally triangular shape and is formed with three fastener openings in the form of screw or bolt openings 26, 27 and 28, through which screws or bolts (not shown) can be inserted for securing the base 12 and, thus, the entire cleat 10 to a deck (not shown) or other part of a boat or other surface.

The screw or bolt openings comprise first and second openings 26 and 27 at opposite sides of the horn 16 as viewed from above, and a third opening 28 located beyond and in line with the horn 18, also as viewed from above. The slot 20 is inclined downwardly towards the third opening 28 and extends downwardly as far as the base.

The upright portion 14 has opposite sides 30 of concave shape, the slot 20 being open through the concave opposite sides 30.

In use of the cleat 10, a rope can be secured in conventional fashion over and under the two horns 16 and 18.

Figure 5:
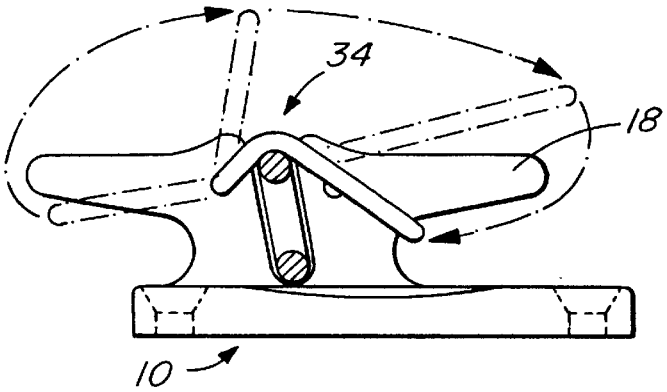
FIGS. 5 through 7 show views corresponding to those of FIGS. 1 through 3 but with the retainer member of FIG. 4 installed on the cleat.
Figure 6:
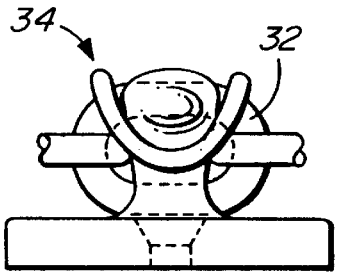
Figure 7:
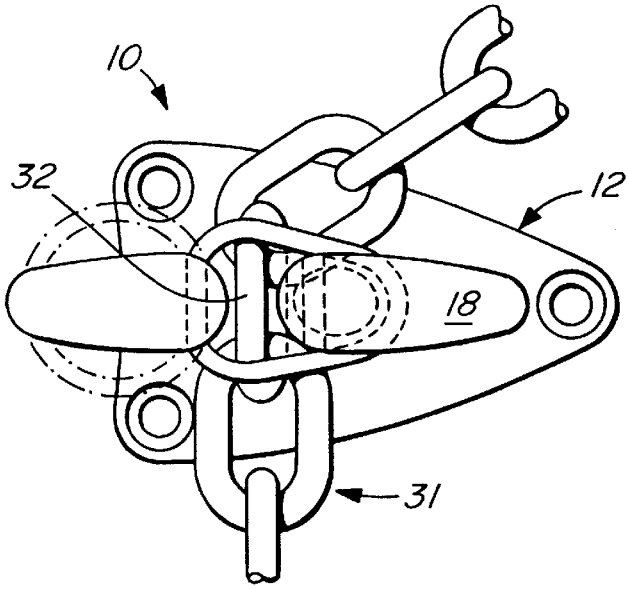

Also, a chain indicated generally by reference numeral 31 can be secured to the cleat 10 by inserting a link 32 of the chain 31 downwardly into the slot 20 as illustrated in FIGS. 5 through 7.

When the chain link 32 has thus been inserted into the slot 20, a line (not shown), for example a cod line or twine, can be threaded through one of the openings 22 and 23 for the purpose of tying the chain 31 to the cleat 10 and, thus, releasibly securing the chain 31 to the cleat 10. The concave shapes of the opposite sides 30 of the upright portion 14 allow the chain 31 to bind into one side 30 of the cleat 10 when the chain 31 is lifted from the opposite side 30 of the cleat 10.

More particularly, when the chain 31 is lifted at only one side of the cleat 10, the two chain links adjourning the link 32 in the slot 20 and at opposite sides of the upright portion 14 bind against the opposite sides 30 of the upright portion 14. The first of these two links to bind against the upright portion 14 is that one opposite from the side of the cleat 10 at which the chain is lifted. The other of these two links at the side of the cleat 10 at which the chain 31 is lifted, travels through an arc which brings this link into firm contact with an upper portion of the respective one of the opposite sides 30. Consequently, further lifting of the chain 31 is prevented. The link, 32 therefore cannot be lifted clear of the slot 20 when the chain is lifted at only one side of the cleat 10. However, when the chain 31 is simultaneously lifted at opposite sides of the cleat 10, the link 32 can thereby be drawn upwardly from the slot 20.

Thus, to remove the chain 31 from the slot 30, it is necessary to lift both sides of the chain 31 at the same time. This is a safety feature which ensures that the chain 31 remains in the cleat 10 at all times when the vessel is left unattended, e.g. when moored in a marina, at a permanent anchorage, and when the anchor is stowed on deck while the vessel is underway.

Figure 4:
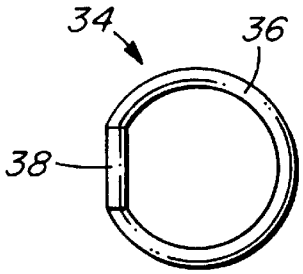
FIG. 4 shows a plan view of a retainer member for use with the cleat of FIG. 1.

A further possibility is to fit through the opening 22 an elongate flexible retainer member, indicated generally by reference numeral 34 in FIG. 4, the retainer member 34 comprising a length 36 of resilient material, e.g. bungee material or Neoprene, the ends of which are secured together by a swaged metal connector 38 so that the retainer member 34 is endless. The connector 38 fits through the opening 22 (FIGS. 5 and 7). This retainer member 34 is dimensioned so as to be resiliently stretchable over the slot 20, as shown in broken lines in FIG. 5, and over the horn 18 at the opposite side of the slot 20 for retaining the chain 31 in the slot 20, as illustrated in FIGS. 5 through 7. The swaged connector 38 is located within the opening 22 so that only the remainder of the retainer member 34 is exposed.

Figure 8:
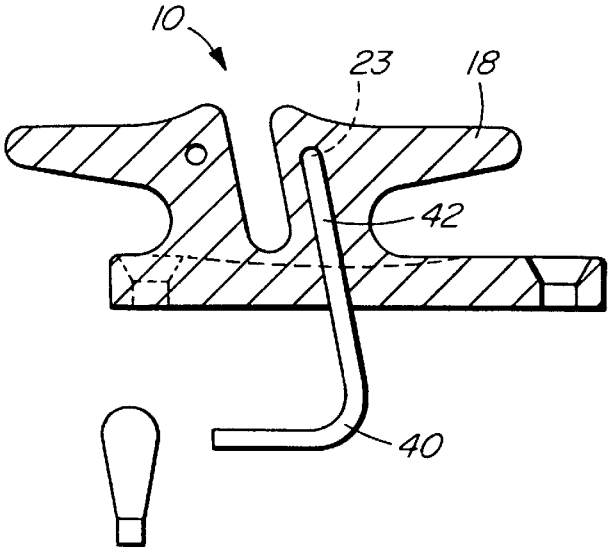
FIGS. 8 through 10 show views corresponding to those of FIGS. 1 through 3 but with the cleat wholely or partially in cross-section to show the addition of a light duct and a light source.
Figure 9:
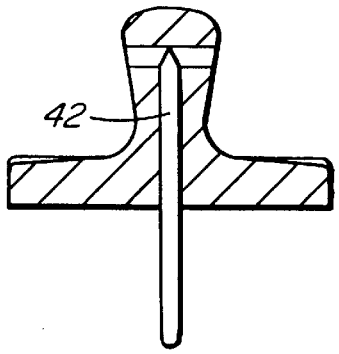
Figure 10:
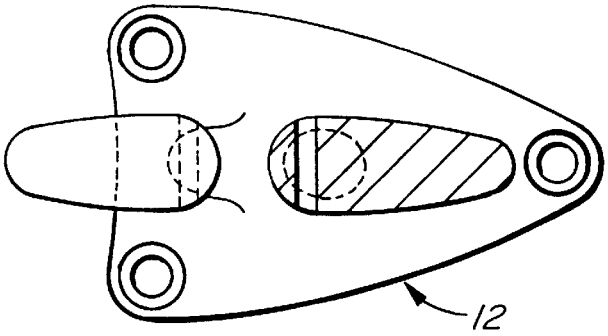

The opening 23 may be provided with a light duct 40 (FIGS. 8 through 10) extending upwardly through the base 12 and the upright portion 14 to the opening 23, with a light-conducting material 42 installed in this light duct 40 and in the opening 23. By this means, light can be transmitted, from a suitable light source, for example a fluorescent lamp 44 in a cabin, to the opening 23 so as to be visible at opposite ends of the opening 23 and, thus, to ensure that the position of the cleat 10 can be readily identified in the dark without any need to install electrical wiring.

As will be apparent to those skilled in the art, various modifications may be made to the above-described cleat within the scope and spirit of the appended claims.

For example, while the cleat 10 shown in the accompanying drawings is a metal casting, it is alternatively possible to manufacture a cleat embodying the present invention by injection moulding of Nylon or other suitable plastic material.

Also, the cleat may be made of Almag (an aluminum-magnesium alloy) or aluminum with a base smaller than the base 12 to enable the cleat to be welded to an aluminum deck. The cleat may be also made, e.g., of mild or high tensile steel or manganese bronze and, if required, chrome plated, depending on the intended usage of the cleat.

I claim:

1. A cleat, comprising:

a cleat base;

an upright portion extending upwardly from said base;

a pair of cleat horns projecting in opposite directions from said upright portion and spaced upwardly from said base; and a chain link reception slot extending downwardly into said upright portion;

said slot being open upwardly and to opposite sides of said upright portion; and said slot being inclined relative to said base.

2. A cleat as claimed in claim 1, further comprising a pair of through-openings extending through said upright portion at opposite sides of said slot.

3. A cleat as claimed in claim 1, further comprising three fastener openings extending vertically through said cleat base, said fastener openings comprising first and second openings at opposite sides of one of said horns, as viewed from above, and a third opening located beyond and in line with the other of said horns, as viewed from above, and said slot being downwardly inclined towards said third hole.

4. A cleat as claimed in claim 1, wherein said upright portion has opposite sides of concave shape, said slot being open through said concave opposite sides.

5. A cleat as claimed in claim 1, further comprising a through-opening extending through said upright portion at one side of said slot, and an elongate flexible retainer member inserted through said opening for use in releasably securing a chain link in said slot.

6. A cleat as claimed in claim 5, wherein said retainer member is endless and resiliently stretchable over said slot and over one of said horns at an opposite side of said slot.

7. A cleat as claimed in claim 1, further comprising a light duct extending from said base through said upright portion, said light duct having an opening to the exterior of said cleat, and light-conducting material installed in said light duct and said opening.

8. A cleat, comprising:

a cleat base;

an upright portion extending upwardly from said base;

a pair of cleat horns projecting in opposite directions from said upright portion and spaced upwardly from said base; and a light duct extending from said base through said upright portion, said light duct having an opening to the exterior of said cleat, and light-conducting material installed in said light duct and said opening.

9. A cleat as claimed in claim 8, further comprising a chain link reception slot extending downwardly into said upright portion, a through-opening extending through said upright portion at one side of said slot, and an elongate flexible retainer member inserted through said opening for use in releasably securing a chain link in said slot.

10. A cleat as claimed in claim 9, wherein said retainer member is endless and resiliently stretchable over said slot and over one of said horns at an opposite side of said slot.

11. A cleat and chain assembly comprising:

a cleat base;

an upright portion extending upwardly from said base;

a pair of cleat horns projecting in opposite directions from said upright portion and spaced upwardly from said base;

a chain link reception slot extending downwardly into said upright portion;

said slot being open upwardly and to opposite sides of said upright portion and a chain;

said chain having a first link releasably engaged in said slot and second and third links at opposite sides of said cleat, said second and third links being connected by said first link.

12. A cleat and chain assembly as claimed in claim 11, wherein said upright portion has opposite sides of concave shape, said slot being open through said concave opposite sides and said second and third links bind against said opposite sides so as to allow said first link to be removed from said slot only by raising both of said second and third links.

13. A cleat and chain assembly as claimed in claim 11, wherein said slot is inclined relative to said base.

14. A cleat and chain as claimed in claim 11, further comprising a pair of through-openings extending through said upright portion at opposite sides of said slot.

15. A cleat and chain assembly as claimed in claim 11, wherein said slot is downwardly inclined towards said base.

16. A cleat and chain assembly as claimed in claim 11, further comprising a through-opening extending through said upright portion at one side of said slot.

17. A cleat and chain assembly as claimed in claim 16, further comprising an elongate flexible retainer member inserted through said opening and releasably securing said first chain link in said slot.

18. A cleat and chain assembly as claimed in claim 17, wherein said retainer member is endless and resiliently stretchable over said slot and over one of said horns at an opposite side of said slot.

19. A cleat and chain assembly as claimed in claim 11, further comprising a light duct extending from said base through said upright portion, said light duct having an opening at the exterior of said cleat, and light-conducting material installed in said light duct and said opening.

* * * * *